US006047408A

United States Patent [19]

Brill, Jr.

[11] Patent Number: 6,047,408

[45] Date of Patent: Apr. 11, 2000

[54] MALE ANTI-DYSFUNCTION BRIEF

[76] Inventor: William R. Brill, Jr., P.O. Box 11, Germantown, Wis. 53022

[21] Appl. No.: 09/374,930

[22] Filed: Aug. 16, 1999

[51] Int. Cl.[7] ..... A41B 9/02

[52] U.S. Cl. ..... 2/403; 2/400

[58] Field of Search ..... 2/400–408; 602/68–74; 606/61; 601/124; 128/842–844; 600/38–40; 604/346, 347, 385, 396

[56] References Cited

U.S. PATENT DOCUMENTS

| | | | |
|---|---|---|---|
| D. 352,577 | 11/1994 | Shover | 2/406 X |
| 4,195,630 | 4/1980 | Connery et al. . | |
| 4,637,078 | 1/1987 | Southwell | 2/408 |
| 4,643,175 | 2/1987 | Chapman . | |
| 4,961,419 | 10/1990 | Tribble et al. | 2/403 X |
| 5,283,912 | 2/1994 | Chung | 2/403 |
| 5,598,587 | 2/1997 | Wada | 2/403 |
| 5,618,279 | 4/1997 | Pudlo | 604/385.1 |
| 5,647,065 | 7/1997 | Richerson | 2/403 |
| 5,713,830 | 2/1998 | Tucker et al. . | |
| 5,870,779 | 2/1999 | Heron | 2/403 |
| 5,873,813 | 2/1999 | Weiss . | |
| 5,875,495 | 3/1999 | Thrower | 2/403 |

*Primary Examiner*—Gloria M. Hale
*Attorney, Agent, or Firm*—Donald J. Ersler

[57] ABSTRACT

A male anti-dysfunction male brief includes a male brief with an opening formed in a front thereof. The opening is formed in the male brief below the junction of the top of the penis with the abdomen. The male brief is preferably fabricated from a synthetic material with elastic properties. The top of the opening in the male brief is preferably reinforced. The remainder of the perimeter may also be reinforced. A modified male brief may also be fabricated by attaching an elastic material to a non-elastic brief in an area above the top of the opening. The remainder of the perimeter in the non-elastic brief may also be reinforced. In use, the opening in the brief is pulled up and slipped over the penis a few minutes before anticipated sexual activity. The force exerted by the elastic brief or the elastic material on the top of the penis at the abdomen is sufficient to decrease the blood flow leaving the penis.

15 Claims, 5 Drawing Sheets

MALE ANTI-DYSFUNCTION BRIEF

BACKGROUND OF THE INVENTION

1. Field of the Invention

The present invention relates generally to male sexual dysfunction and more specifically to a male anti-dysfunction brief.

2. Discussion of the Prior Art

Male sexual dysfunction is an unfortunate affliction to many of the male population. There are numerous solutions available on the market to overcome sexual dysfunction, such as surgery, drugs, and mechanical devices. However, some of the mechanical devices have drawbacks. One type of male anti-dysfunction device utilizes a ring to impede the blood exiting the top of the penis. The drawback to this type of device is slippage during use and the possible necessity of readjustment at an inappropriate time. The problem of slippage has been addressed by attaching a ring or the like to a waist band device. Unfortunately, the waist band may also slip and require readjustment at an inappropriate time. The above devices may also be physically uncomfortable to wear.

Accordingly, there is a clearly felt need in the art for a male anti-dysfunction brief which is comfortable to wear and does not need adjustment at an inappropriate time.

SUMMARY OF THE INVENTION

The primary objective of the present invention is to provide a anti-dysfunction brief which is comfortable to wear and does not need adjustment at an inappropriate time.

According to the present invention, a male anti-dysfunction male brief includes a male brief with an opening formed in a front thereof. The opening is formed in the male brief below the junction of the top of the penis with the abdomen. The male brief is preferably fabricated from a synthetic material with elastic properties. The top of the opening in the male brief is preferably reinforced with stitching, gluing, sonic welding, heat sealing, laser welding or other suitable process. The remainder of the perimeter may also be reinforced with stitching, gluing, sonic welding, heat sealing, laser welding or other suitable process.

A modified male brief may also be fabricated by attaching an elastic material to a non-elastic brief in an area above the top of the opening with stitching, gluing, sonic welding, heat sealing, laser welding or other suitable process. The remainder of the perimeter in the non-elastic brief may also be reinforced with stitching, gluing, sonic welding, heat sealing, laser welding or other suitable process.

In use, the opening in the brief is pulled up and slipped over the penis a few minutes before anticipated sexual activity. The force exerted by the elastic brief or the elastic material on the top of the penis at the abdomen is sufficient to decrease the blood flow leaving the penis.

Accordingly, it is an object of the present invention to provide a male anti-dysfunction brief which is comfortable to wear compared to the prior art devices.

Finally, it is another object of the present invention to provide a male anti-dysfunction brief which does not require adjustment during use unlike some prior art devices.

These and additional objects, advantages, features and benefits of the present invention will become apparent from the following specification.

DETAILED DESCRIPTION OF THE PREFERRED EMBODIMENTS

Figure 1:
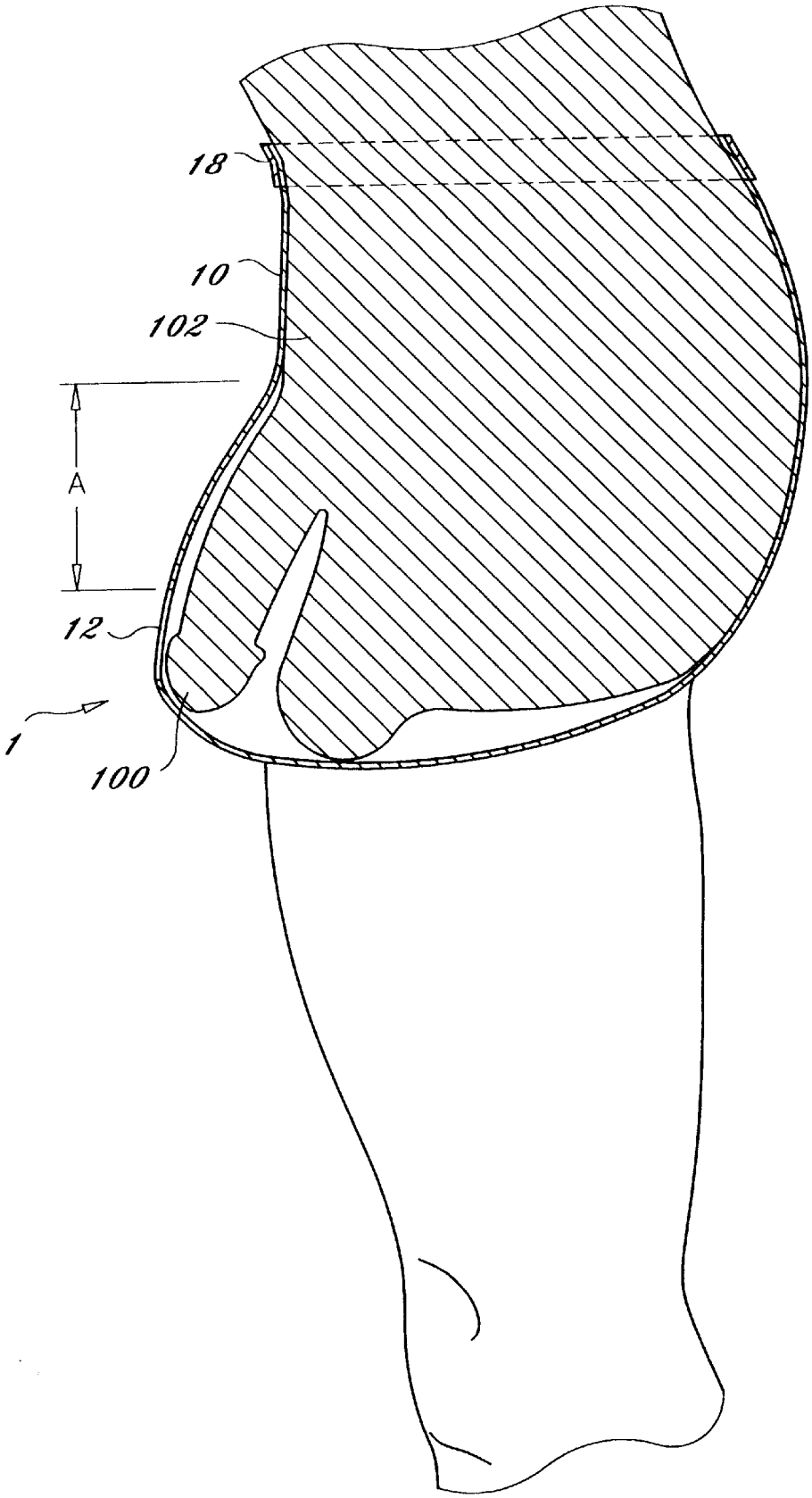
FIG. 1 is a cross-sectional view of a male anti-dysfunction brief worn by a user before use in accordance with the present invention.
Figure 2:
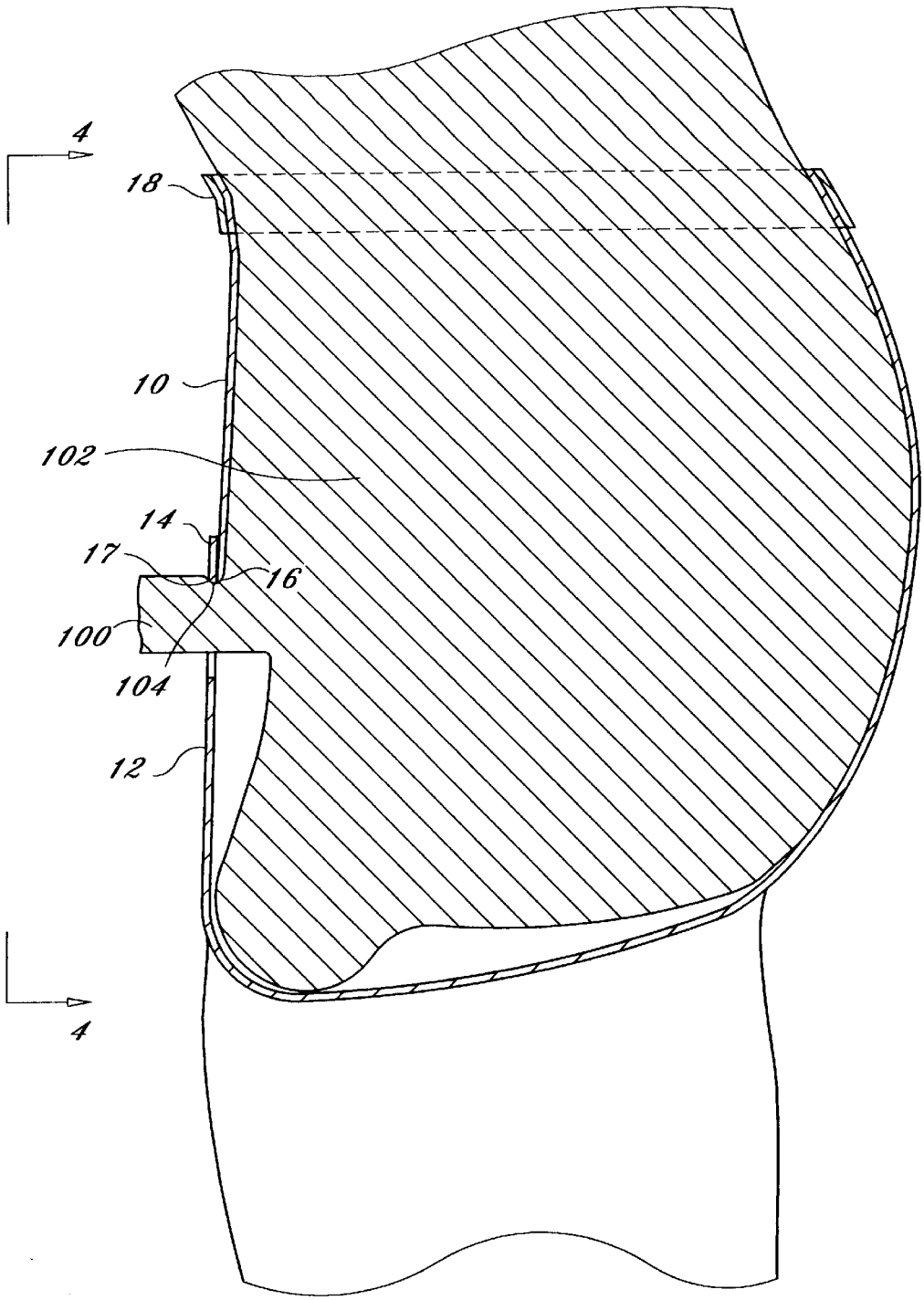
FIG. 2 is a cross sectional view of a male anti-dysfunction brief worn by a user after a short period of time in accordance with the present invention.
Figure 3:
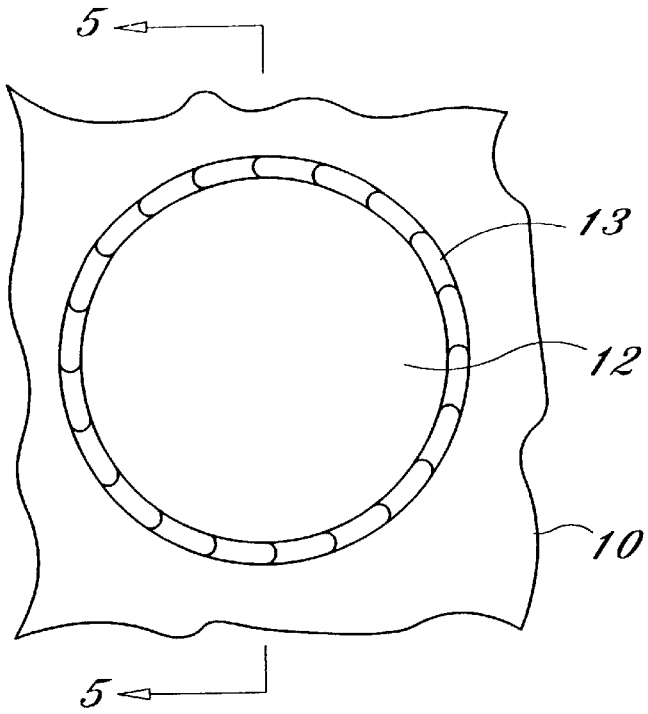
FIG. 3 is a front view of a reinforced round opening formed in a brief fabricated in accordance with the present invention.
Figure 5:
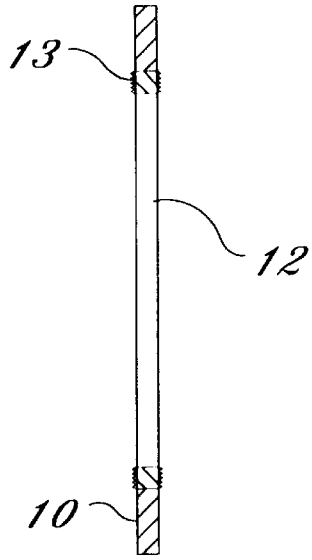
FIG. 5 is a cross-sectional view of a reinforced round opening formed in a male brief in accordance with the present invention.
Figure 4:
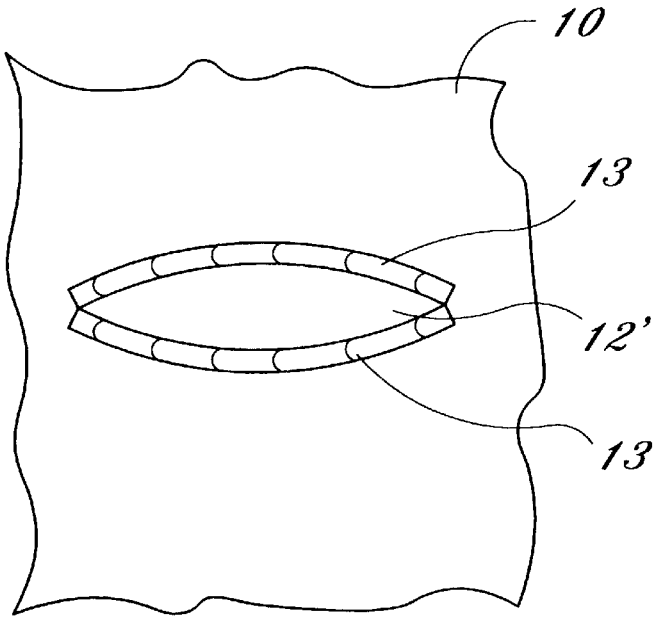
FIG. 4 is a front view of a reinforced slit opening formed in a brief fabricated in accordance with the present invention.

With reference now to the drawings, and particularly to FIG. 1, there is shown a cross-sectional view of a male anti-dysfunction brief 1. With reference to FIGS. 2–5, the male anti-dysfunction brief 1 includes a male brief 10 with a top 16 of an opening 12 formed therein below the top of the [penis 100. The opening 12 is formed in the male brief 10 below the] junction of the penis 100 with the abdomen 102. The distance A between the top of the penis 100 and the top of the opening 12 is preferably between 1–2 inches. It is preferable that the shape of the opening 12 be substantially round as shown in FIG. 3, but could be any other shape including a slit as shown in FIG. 4. The perimeter of the opening 12 preferably has a reinforced area 13. The reinforced area 13 may be implemented with stitching, gluing, sonic welding, heat sealing, laser welding, or other suitable process. It is preferable that a top 16 of the opening 12 be smooth and rounded for comfort. The opening 12 is preferably large enough to allow clearance for the bottom and sides of the penis 100.

The male brief 10 is preferably fabricated from a synthetic material with elastic properties. The synthetic material is preferably a combination of 90%–85% nylon and 10%–15% LYCRA spandex, but could be any synthetic substance with similar elastic qualities. (Spandex is NOT a registered federal trademark, but a generic name for a synthetic substance.) The male brief 10 preferably includes an elastic waist band 18 disposed at a top thereof. The male brief 10 is preferably similar in design to a normal brief with bottom support, but without an opening for urination.

Figure 6:
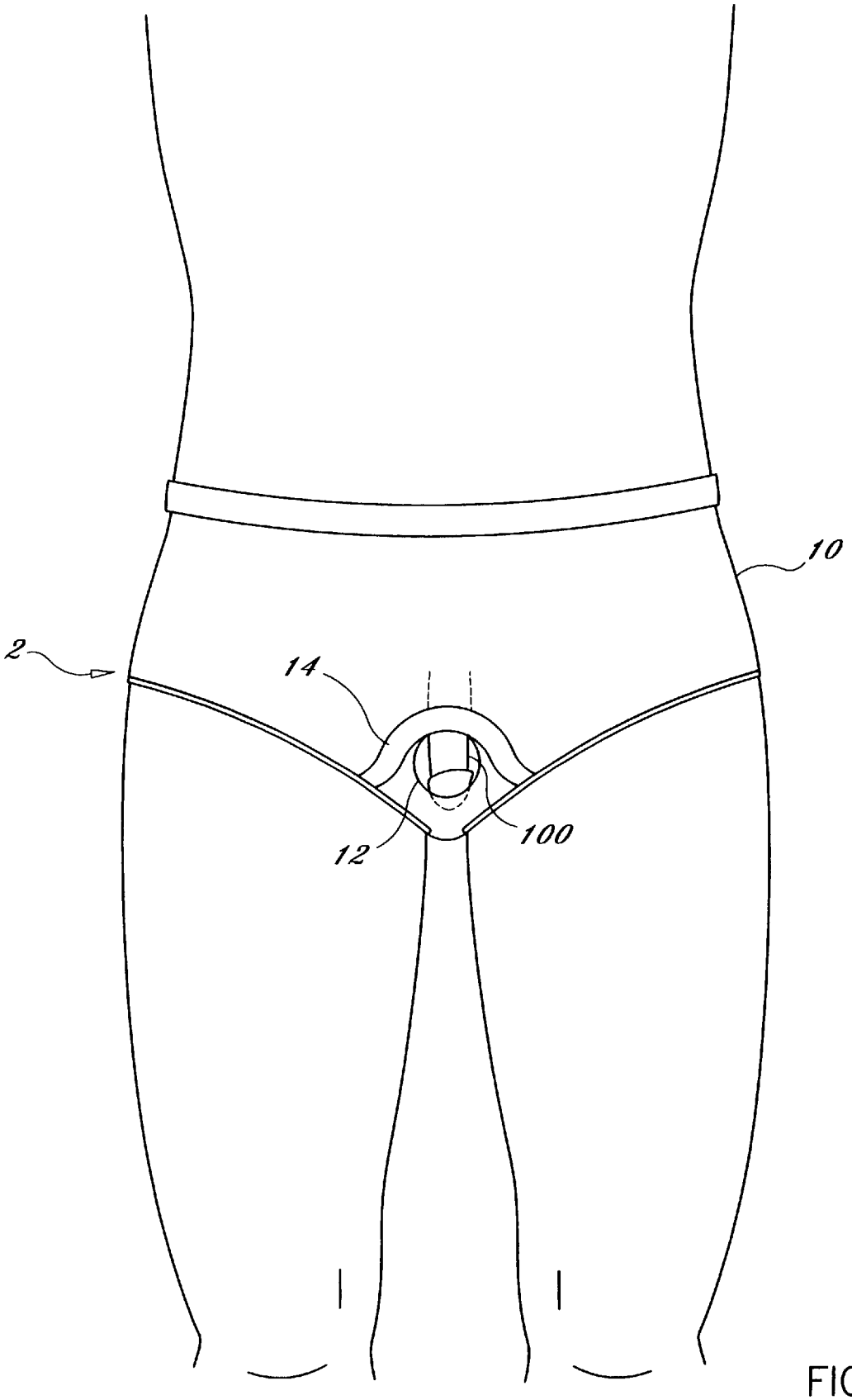
FIG. 6 is a front view of a male anti-dysfunction brief worn by a user before use in accordance with the present invention.
Figure 7:
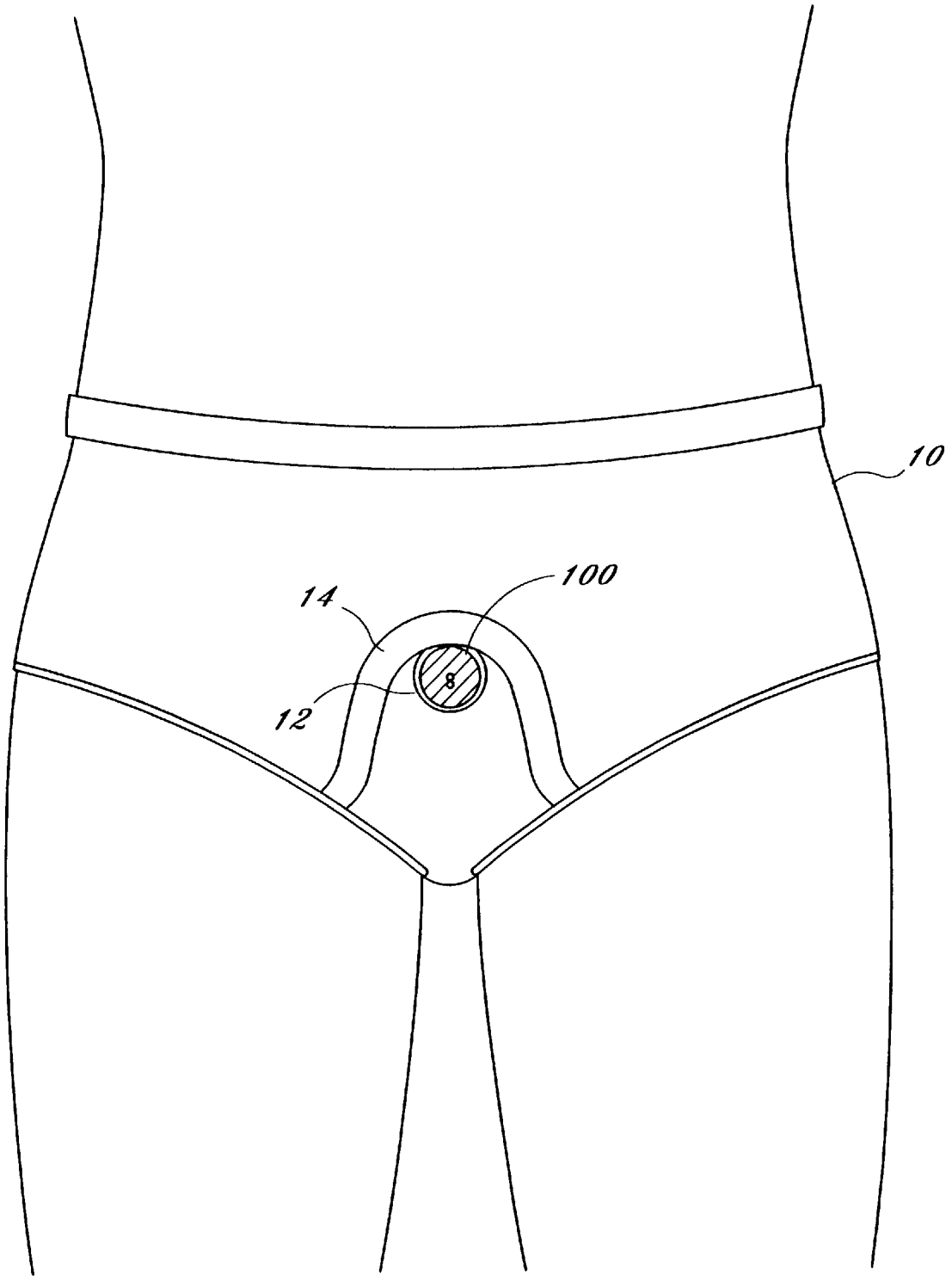
FIG. 7 is a front view of a male anti-dysfunction brief worn by a user after a short period of time in accordance with the present invention.

The male brief 10 may also be fabricated from cotton or a cotton/synthetic blend. With reference to FIGS. 6 and 7, an elastic material 14 is attached above the opening 12 with stitching, gluing, sonic welding, heat sealing, laser welding or other suitable process. It is preferable that a bottom 17 of the elastic material 14 and a top 16 of the opening 12 be smooth and rounded for comfort. An opening 12 may also be created in a male jockey brief. The elastic material 14 would be attached above the opening 12 to create the same function as the male anti-dysfunction brief 1.

However, the male brief 10 need not be shaped as shown, but could be any other shape or design which provides the function disclosed in this patent application.

In use, the opening 12 in the brief 10 is pulled up and the penis 100 is inserted therethrough a few minutes before anticipated sexual activity. With reference to FIG. 2, the force exerted by the top 16 of the male brief 10 fabricated from an elastic material, or the bottom 17 of the elastic material 14 will push into the top of the penis 100 at pressure point 104 to decrease the blood flow leaving the penis 100. It is believed that high blood pressure inside the penis is what causes an erection. Restricting the amount of blood leaving the penis will cause the blood pressure inside the penis to increase. The force exerted by the top 16 or the bottom 17 will cause an increase in blood pressure inside the penis, thus producing and maintaining an erection, while having the unexpected result of preventing premature ejaculation.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A male anti-dysfunction brief comprising:

a male brief having an opening in a front thereof, an elastic material being fastened to said male brief above a top of said opening, said top of said opening being disposed below the juncture between a top of the penis and the abdomen, said elastic material for exerting pressure such that a male user with sexual dysfunction will experience an erect penis after the penis is inserted through said opening.

2. The male anti-dysfunction brief of claim 1, wherein:

a perimeter of said opening is reinforced.

3. The male anti-dysfunction brief of claim 1, wherein:

said elastic material for exerting pressure on a penis such that a male user with sexual dysfunction will not have a premature ejaculation.

4. The male anti-dysfunction brief of claim 1, wherein:

said opening has a round shape.

5. The male anti-dysfunction brief of claim 1, wherein:

said opening is a slit.

6. A male anti-dysfunction brief comprising:

a male brief being fabricated from an elastic material, said male brief having an opening in a front thereof, said opening reinforced at a top thereof, said top of said opening being disposed below the juncture between a top of the penis and the abdomen of a wearer, said elastic material for exerting pressure such that a male user with sexual dysfunction will experience an erect penis after the penis is inserted through said opening.

7. The male anti-dysfunction brief of claim 6, wherein:

a perimeter of said opening is reinforced.

8. The male anti-dysfunction brief of claim 6, wherein:

said elastic material for exerting pressure on a penis such that a male user with sexual dysfunction will not have a premature ejaculation.

9. The male anti-dysfunction brief of claim 6, wherein:

said opening has a round shape.

10. The male anti-dysfunction brief of claim 6, wherein:

said opening is a slit.

11. A method for modifying a male jockey brief to prevent male anti-dysfunction, comprising the steps of:

(a) forming an opening in a front of said male jockey brief, a top of said opening being formed below the juncture between a top of the penis and the abdomen;

(b) fastening an elastic material to said male brief above a top of said opening; and (c) providing elastic material for exerting pressure such that a male user with sexual dysfunction will experience an erect penis.

12. The method for modifying a male jockey brief to prevent male anti-dysfunction of claim 11, wherein:

a perimeter of said opening is reinforced.

13. The method for modifying a male jockey brief to prevent male anti-dysfunction of claim 11, wherein:

said elastic material for exerting pressure on a penis such that a male user with sexual dysfunction will not have a premature ejaculation.

14. The method for modifying a male jockey brief to prevent male anti-dysfunction of claim 11, wherein:

said opening is a round shape.

15. The method for modifying a male jockey brief to prevent male anti-dysfunction of claim 11, wherein:

said opening is a slit.

* * * * *